US010912438B2

(12) United States Patent
Li

(10) Patent No.: US 10,912,438 B2
(45) Date of Patent: Feb. 9, 2021

(54) SWEEPING ROBOT AND CORRESPONDING CLEANING DEVICE

(71) Applicant: HiZero Technologies Co., Ltd., Shenzhen (CN)

(72) Inventor: Yang Li, Guangdong (CN)

(73) Assignee: HiZero Technologies Co., Ltd., Shenzhen (CN)

( * ) Notice: Subject to any disclaimer, the term of this patent is extended or adjusted under 35 U.S.C. 154(b) by 192 days.

(21) Appl. No.: 16/050,896

(22) Filed: Jul. 31, 2018

(65) Prior Publication Data

US 2019/0246859 A1 Aug. 15, 2019

Related U.S. Application Data

(63) Continuation-in-part of application No. PCT/CN2018/076684, filed on Feb. 13, 2018.

(51) Int. Cl.
*A47L 11/292* (2006.01)
*A47L 11/40* (2006.01)

(52) U.S. Cl.
CPC ..... *A47L 11/292* (2013.01); *A47L 11/4011* (2013.01); *A47L 11/4016* (2013.01); (Continued)

(58) Field of Classification Search
CPC .. A47L 11/282; A47L 11/292; A47L 11/4016; A47L 11/4041; A47L 11/4083; A47L 11/4088
See application file for complete search history.

(56) References Cited

U.S. PATENT DOCUMENTS 4,196,492 A * 4/1980 Johnson ..... A47L 11/34 15/320
6,026,529 A 2/2000 Caruso
(Continued)

FOREIGN PATENT DOCUMENTS

CA 2085267 A1 6/1994
CN 201019680 Y 2/2008
(Continued)

OTHER PUBLICATIONS

Corresponding Japanese Patent Application No. 2018-219917, Japanese Office Action, dated Jan. 15, 2020. English Translation.
(Continued)

*Primary Examiner* — Randall E Chin
(74) *Attorney, Agent, or Firm* — Cooper Legal Group, LLC

(57) ABSTRACT

The disclosure relates to a sweeping robot and a cleaning device. The sweeping robot includes: a flexible roller for cleaning the ground, a roller motor for driving the flexible roller to rotate, a pressing member for deforming the flexible roller to press out sewage. Clean water in the clean water sink flows through the clean water hole to the flexible roller. The sweeping robot further includes a sewage sink. The sewage sink is provided with a sewage hole is adjacent to the pressing member. The pressing member deforms the flexible roller, causing sewage to be pressed out of the flexible member and flow through the sewage hole into the sewage sink. The sewage sink is separated from the clean water sink. The cleaning device of the present invention has strong cleaning ability, and the flexible roller is easy to clean.

8 Claims, 9 Drawing Sheets

(52) U.S. Cl.
CPC ..... *A47L 11/4041* (2013.01); *A47L 11/4069* (2013.01); *A47L 11/4083* (2013.01); *A47L 11/4088* (2013.01)

(56) References Cited

U.S. PATENT DOCUMENTS

| | | | |
|---|---|---|---|
| 2013/0219641 | A1 | 8/2013 | Guijarro |
| 2014/0208527 | A1 | 7/2014 | Lin |
| 2015/0082579 | A1 | 3/2015 | Lin |

FOREIGN PATENT DOCUMENTS

| | | | |
|---|---|---|---|
| CN | 101190117 | A | 6/2008 |
| CN | 201814516 | U | 5/2011 |
| CN | 202341952 | U | 7/2012 |
| CN | 202960388 | U | 6/2013 |
| CN | 103393384 | A | 11/2013 |
| CN | 203263303 | U | 11/2013 |
| CN | 104257330 | A | 1/2015 |
| CN | 204133379 | U | 2/2015 |
| CN | 105342528 | A | 2/2016 |
| CN | 205181250 | U | 4/2016 |
| CN | 106821152 | A | 6/2017 |
| CN | 107669214 | A | 2/2018 |
| DE | 2804702 | A1 | 2/1979 |
| EP | 2641524 | A1 | 9/2013 |
| EP | 3238596 | A1 | 11/2017 |
| EP | 3238598 | A1 | 11/2017 |
| JP | H0255027 | A | 2/1990 |
| JP | H04-000354 | U | 1/1992 |
| JP | H05123278 | A | 5/1993 |
| JP | 2013086127 | A | 5/2013 |
| JP | 3186168 | U | 9/2013 |
| JP | 2014045898 | A | 3/2014 |
| JP | 2014233524 | A | 12/2014 |

OTHER PUBLICATIONS

Corresponding Great Britain Patent Application No. GB1815896.4, Great Britain Search Report, dated Feb. 25, 2019.
Corresponding European Patent Application No. 18250024.9, European partial Search Report, dated Apr. 24, 2019.
Corresponding European Patent Application No. 18250024.9, European extended Search Report, dated Aug. 2, 2019.
Corresponding Japanese Patent Application No. 2018-219917, Japanese Office Action, dated Sep. 28, 2020. English Translation.

* cited by examiner

SWEEPING ROBOT AND CORRESPONDING CLEANING DEVICE

RELATED APPLICATIONS

This application is a continuation-in-part of and claims priority to PCT/CN2018/076684, filed on Feb. 13, 2018, which is incorporated herein by reference.

FIELD OF THE DISCLOSURE

The present disclosure relates to the technical field of cleaning equipment, in particular to a cleaning robot and a cleaning device thereof.

BACKGROUND OF THE DISCLOSURE

Sweeping robots are self-cleaning devices that reduce the pressure on people to clean. Sweeping robots generally use the structure of roller brushes, rollers, sewage collecting tanks, and water tanks. Clean water from one end of a sewage collecting tank is supplied to the roller, and the sewage discharged from the roller is absorbed into the sewage collecting tank through negative pressure. This kind of structure mixes clean water and sewage in the process of cleaning and does not separate dirty sewage from clean water. In the process of cleaning the floor, the roller is easily stained with dirt, which is not conducive to the cleaning of the roller, and the cleaning ability of the self-cleaning device is greatly reduced.

SUMMARY OF THE DISCLOSURE

According to various embodiments of the present application, there is provided a cleaning device that has a strong cleaning ability and a flexible roller that is easy to clean. In order to achieve the purpose of the present disclosure, the present disclosure adopts the following technical solutions.

A cleaning device comprising: a flexible roller for cleaning the floor; a roller motor for driving the flexible roller to rotate; a pressing member for deforming the flexible roller to press out sewage; a clean water sink, wherein a gap is between the clean water sink and the flexible roller, the clean water sink defines a clean water hole, and the clean water in the clean water sink flows to the flexible roller through the clean water hole; and a sewage sink, wherein a gap is between the sewage sink and the flexible roller, and the sewage sink defines a sewage hole, wherein the sewage sink is adjacent to the pressing member. When the pressing member deforms the flexible roller, sewage that is pressed out of the flexible roller passes through the sewage hole and flows to the sewage sink, wherein the sewage sink is set apart from the clean water sink.

A cleaning device, comprising: a flexible roller for cleaning the floor; a roller motor for driving the flexible roller to rotate; a pressing member for deforming the flexible roller to press out sewage; a cleaning drive member connected to the pressing member for controlling the pressing member to press down the flexible roller; a plurality of water tanks, including a clean water tank and a sewage tank; a water sink, wherein a gap is between the water sink and the flexible roller, wherein a water hole is disposed at the bottom of the water sink and clean water flows from the water hole onto a surface of the flexible roller through the gap; one end of the water sink is connected to the clean water tank through a clean water pipe, and a clean water solenoid valve is provided on the clean water pipe, the other end of the water sink is connected to a sewage tank through a sewage pipe, and a sewage electromagnetic valve is provided on the sewage pipe; a controller electrically connects to the clean water solenoid valve and the sewage electromagnetic valve, wherein the controller is used to control the clean water solenoid valve to alternately open at intervals between the sewage electromagnetic valve and the cleaning drive member.

The details of one or more embodiments of the disclosure are set forth in the accompanying drawings and the description below. Other features, objects, and advantages of the disclosure will be apparent from the description and drawings, and from the claims.

BRIEF DESCRIPTION OF THE DRAWINGS

For a better description and illustration of embodiments and/or examples of those disclosed herein, reference may be made to one or more of the drawings. Additional details or illustrations used to describe the drawings should not be taken as limiting the scope of any of the disclosed disclosures, presently described embodiments and/or examples, and currently understood disclosures.

DETAILED DESCRIPTION OF THE EMBODIMENTS

To facilitate an understanding of the present disclosure, the present disclosure will be described more fully hereinafter with reference to the accompanying drawings. The preferred embodiments of the disclosure are given in the accompanying drawings. However, the present disclosure may be embodied in many different forms and is not limited to the embodiments described herein. Rather, these embodiments are provided so that this disclosure will be thorough and complete. It should be noted that when an assembly is referred to as being "fixed" to another component, it may be directly on another component or there may also be an intervening component. When a component is considered to be "connected" to another component, it can be directly connected to another component or there may be an intervening element. Unless otherwise defined, all technical and scientific terms used herein have the same meaning as commonly understood by one of ordinary skill in the art to which this disclosure belongs. The terminology used herein in the description of the present disclosure is for the purpose of describing particular embodiments only and is not intended to limit the present disclosure.

Embodiment 1

Figure 1:
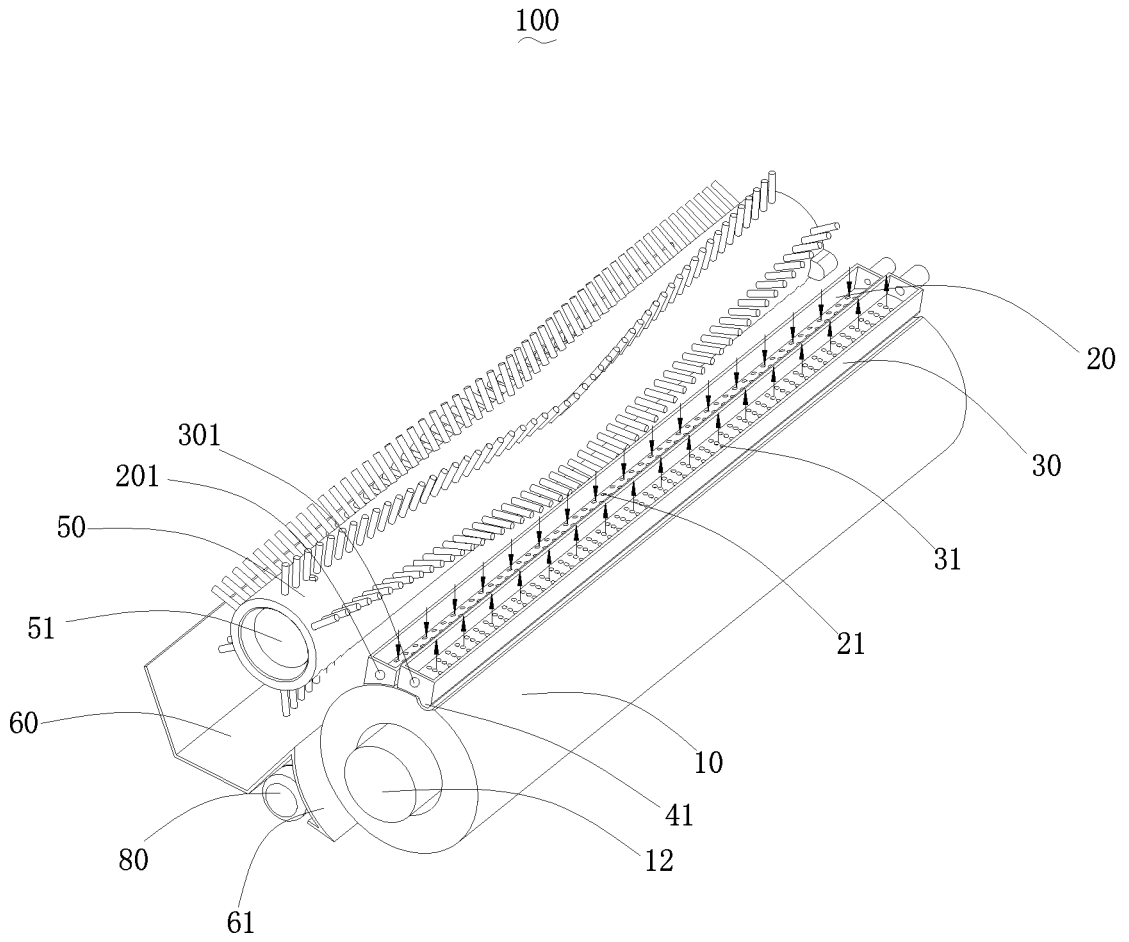
FIG. 1 is a schematic view of an overall structure of a cleaning apparatus according to an embodiment of the present disclosure.
Figure 2:
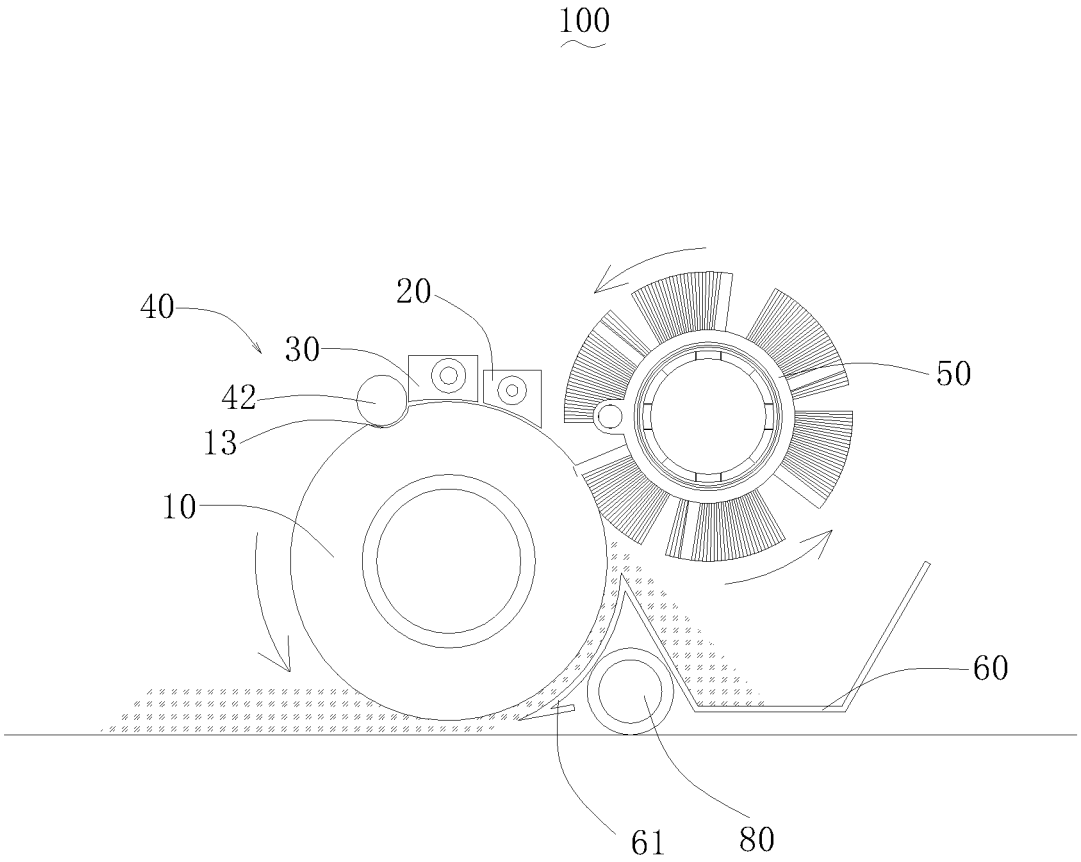
FIG. 2 is another schematic structural view of the cleaning apparatus shown in FIG. 1.

Referring to FIGS. 1 and 2, a cleaning robot according to a preferred embodiment of the present disclosure includes a shell and a cleaning device 100 located in the shell. The cleaning device 100 includes a flexible roller 10 and a roller motor 12 for driving the flexible roller 10 to rotate. The cleaning device 100 also includes a clean water sink 20 spaced apart from the flexible roller 10 by a gap, a sewage sink 30 spaced apart from the flexible roller 10 by a gap, and a pressing member 40 for deforming the flexible roller 10 to press out the sewage. The cleaning device 100 also includes a roller brush 50 on a side of the flexible roller 10, a garbage collection box 60, and a water tank 70 for containing water. Wherein the bristles on the roller brush 50 contact the flexible roller 10, and the garbage collection box 60 is located at least partially below the roller brush 50. Solid waste is swept into the garbage collection box 60 and liquid waste is absorbed in the flexible roller 10. During the rotation of the flexible roller 10, fresh water in the clean water sink 20 flows into the flexible roller 10 to provide clean water for the flexible roller 10. The flexible roller 10 absorbs the liquid waste on the ground and the sewage mixed therewith when the floor is cleaned, and the flexible roller 10 absorbs the sewage that is pressed into the pressing member 40 while the flexible roller 10 is rotating. The portion of the flexible roller 10 that contacts the pressing member 40 is compressed by the pressing member 40, generating the amount of compression that allows the sewage absorbed by the flexible roller 10 to be pressed upwards so that the sewage has an upward pressure and flows upward. In addition, the flexible roller 10 generates an upward deformation on both sides of the compressed portion, so that the side of the compressed portion of the flexible roller 10 that is originally round or nearly round fills the gap between the water sinks. The discharged sewage is upwardly driven due to the upward pressure and pressed into the sewage sink 30. When the upward pressure generated by the deformation is greater than the gravity of the sewage stored in the sewage sink 30 plus the sewage stored in the sewage pipe, the sewage flows into the sewage sink 30 to recover the sewage. The sewage sink 30 and the clean water sink 20 are separated from each other so that during the rotation of the flexible roller 10, the clean water and the sewage can be separated from each other to avoid mixing together. Thus, the clean water is used to clean the flexible roller 10, the generated sewage is pressed out of the flexible roller 10, and the flexible roller 10 is easier to clean. The cleaning ability of the flexible roller is also stronger.

The rotating shaft of the flexible roller 10 is made of a hard material, and the outer peripheral portion thereof is made of a flexible material, for example, made of a sponge, a cotton cloth, or the like. Water is easily absorbed due to the porosity of the material and the surface cleaning force and easily achieves cleaning function. The flexible roller 10 is driven to rotate by a motor, and the motor is also mounted inside the shell. The rotation speed of the flexible roller 10 affects the cleaning ability, so it is necessary to properly set the rotation speed of the flexible roller 10 and to use different speeds when cleaning different environments. The basic principle is that the level of sweeping torque provided by a specific speed on the ground needs to be greater than the friction between the solid waste and the ground and the total viscosity. Alternatively, the specific rotational speed of the unit area must be longer or at least equal to the time required to completely remove the garbage. Moreover, the downward pressure provided to the ground needs to be sufficient to prevent the garbage from further movement, so that the garbage on the ground can be completely captured using the aforementioned level of sweeping torque to achieve the effect of cleaning the ground. For example, the rotational speed of the flexible roller 10 can be set at 50-140 rotations per minute (rpm). In a preferred embodiment, the rotational speed of the flexible roller 10 can be set at 70 rpm. The smoother the ground (i.e., the lower the friction of the ground against the garbage), the lower the required rotational speed.

The sewage sink 30 is provided separately from the clean water sink 20. The clean water sink 20 provides the flexible roller 10 with clean water, and the sewage sink 30 collects the sewage discharged from the flexible roller 10.

In this embodiment, a clean water hole 21 is disposed in the bottom or side of the clean water sink 20, and the clean water in the clean water sink 20 flows to the flexible roller 10 through the clean water hole 21. The clean water sink 20 is disposed above the flexible roller 10 and a gap is defined between the clean water sink 20 and the flexible roller 10. Both sides of the clean water sink 20 define a water inlet 201. The water inlet 201 communicates with a clean water tank, and clean water in the clean water tank enters the clean water sink 20 through the water inlet. Fresh water in the clean water sink 20 enters the flexible roller 10 through the clean water hole 21. Of course, two inlet ports may be provided or one inlet port may be provided, and the inlet water may be controlled by providing solenoid valves at one or both inlet ports. When the flexible roller 10 starts to work, one or two solenoid valves are opened, the flexible roller 10 is replenished with clean water. The solenoid valve is closed when cleaning is completed. In this embodiment, in order to prevent backflow of clean water, the water inlet 201 is disposed above the two sides of the clean water sink 20, and the clean water hole 21 is disposed at the bottom of the clean water sink 20.

The water tank 70 includes a clean water tank 73 and a sewage tank 74. The clean water tank 73 and the sewage tank 74 may be separately formed or may be integrally formed and separated (e.g., by a divider).

The sewage sink 30 is located on one side of the clean water sink 20, and the sewage sink 30 defines a sewage hole 31. The sewage in the sewage sink 30 flows from the flexible roller 10 to the sewage sink 30 through the sewage hole 31. A water outlet 301 is provided on both sides or one side of the sewage sink 30. When sewage is accumulated in the sewage sink 30, it can be discharged to the sewage tank 74 through the water outlet(s) 301. The amount of sewage discharged through the water outlet(s) 301 can be controlled by a solenoid valve(s) at the water outlet(s) 301. The water outlet(s) 301 is located at a side of the sewage sink 30 near the bottom, so as to guide the outflow of sewage. When there is a lot of sewage in the middle of a cleaning task or when the cleaning task is completed, one or two solenoid valves are opened so that the sewage in the sewage sink 30 is pumped into the sewage tank 74.

Further, a vacuum pump may be connected to the sewage sink 30 to provide a negative pressure for the sewage sink 30 to provide power for pumping the sewage in the sewage sink 30. For example, when the sewage in the sewage sink 30 needs to be extracted, the solenoid valve(s) and the vacuum pump at the water outlet(s) 301 of the sewage sink 30 are simultaneously turned on, the sewage is extracted through the negative pressure, and the solenoid valve is closed when the vacuum pump is turned off. The pressing member 40 is made of a material with a low coefficient of elasticity so that the flexible roller 10 can be extruded. For example, a wooden material, a plastic material, a metal material, or the like can be used to achieve the above object. The pressing member 40 may also be a composite material using a plurality of materials, for example, a body made of plastic, and applying a metal layer reinforcement on a contact surface with the highest contact pressure. Referring to FIG. 2, the pressing member 40 is a pressure column 42. The pressure column 42 has a cylindrical shape. The pressure column 42 is disposed near the sewage sink 30 so as to press sewage into the sewage sink 30, and the surface of the pressure column 42 is pressed against the surface of the flexible roller 10.

In other embodiments, the pressure column 42 may instead have a spherical shape or the like. The pressure column 42 presses the flexible roller 10 so that the surface of the flexible roller 10 forms a recessed portion 13. The portion of the pressure column 42 located at the recessed portion 13 is ¼-½ of a radius or diameter of the pressure column 42. This will not affect the normal rotation of the flexible roller 10, but will cause the sewage to be pressed out. Of course, the flexible roller 10 can also be rotated when size of the pressing column 42 for pressing downward is large. In this embodiment, the portion of the pressure column 42 located at the recessed portion 13 is ⅓ of the radius or diameter of the pressure column 42, which is a preferred pressing size. When the flexible roller 10 rotates, the pressure column 42 generates a downward pressure on a portion of the flexible roller 10 near the side of the sewage sink 30 and adjacent to the sewage hole 31 of the sewage sink 30. Thus, a large proportion of the sewage enters the sewage sink 30, thereby avoiding sewage overflows that may pollute the ground and have to be wiped clean.

In other embodiments, the pressing member 40 is a protrusion 41 provided at the bottom of the sewage sink 30. The protrusion 41 may be disposed at the bottom edge of the sewage sink 30 or may be disposed at a middle position of the bottom of the sewage sink 30. In this embodiment, the protrusion 41 is disposed on the bottom edge of the sewage sink 30 and is integrally formed with the sewage sink 30. When the flexible roller 10 rotates, the protrusion 41 generates a downward pressure on a portion of the flexible roller 10 near the side of the sewage sink 30 adjacent to the sewage hole 31 of the sewage sink 30 so that a large proportion of the sewage enters the sewage sink 30. Accordingly, sewage overflows that pollute the ground and have to be wiped clean are avoided. In a preferred embodiment, through the sealing of the sewage sink, a ratio of the sewage entering the sewage tank reaches to 85%-95%. Further, when the sewage sink is separated from the clean water sink, the pressure roller is located on one side of the sewage sink 302. Through the foregoing configuration, this embodiment discloses a sweeping robot that does not need to generate a negative pressure through an air pump during the recovery of sewage. Instead, the sewage is introduced into the sewage tank by the upward pressure generated when the flexible roller 10 is pressed. Through such technology, by not using the air pump, the cost and the failure rate can be reduced to provide a great advantage over conventional technologies.

It can be understood that the number of pressure columns 42 may be one or a plurality. The plurality of pressure columns 42 may be provided without affecting the normal operation of the cleaning device 100. In this embodiment, the number of pressure columns 42 is one, and the pressure column 42 and the roller brush 50 are respectively located on both sides of the sewage sink 30 and the clean water sink 20. The pressure column 42 is mounted within the shell, for example, integral with the shell, or is mounted within the shell through a mounting bracket near the sewage sink 30.

Referring to FIGS. 1 and 2, the roller brush 50 is located above the side wall of the flexible roller 10. The roller brush 50 is driven by a roller brush motor 51. When the flexible roller 10 rolls, the roller brush 50 rolls in the opposite direction of the flexible roller 10. The dirt on the flexible roller 10 is brushed off and falls into the garbage collection box 60 below, thereby achieving the purpose of removing the dirt.

The garbage collection box 60 is disposed in the direction of rolling of the flexible roller 10 and a gap is defined between the garbage collection box 60 and the flexible roller 10. The garbage collection box 60 is located on one side of the flexible roller 10 and is located directly below the roller brush 50. The garbage collection box 60 collects some garbage, and the remaining garbage is brushed off by the roller brush 50. The garbage collection box 60 is U-shaped, but is arranged in a square shape at the corners.

Further, a scraper 61 is provided on a side of the garbage collection box 60 near the flexible roller 10 for receiving garbage falling from the flexible roller 10. A load-bearing wheel 80 is disposed between the garbage collection box 60 and the scraper 61 for increasing the load-bearing capacity of the garbage collection box 60. The scraper 61 is disposed in an arc shape and has one end connected to one side of the garbage collection box 60 abutting one side of the flexible roller 10.

Embodiment 2

Figure 3:
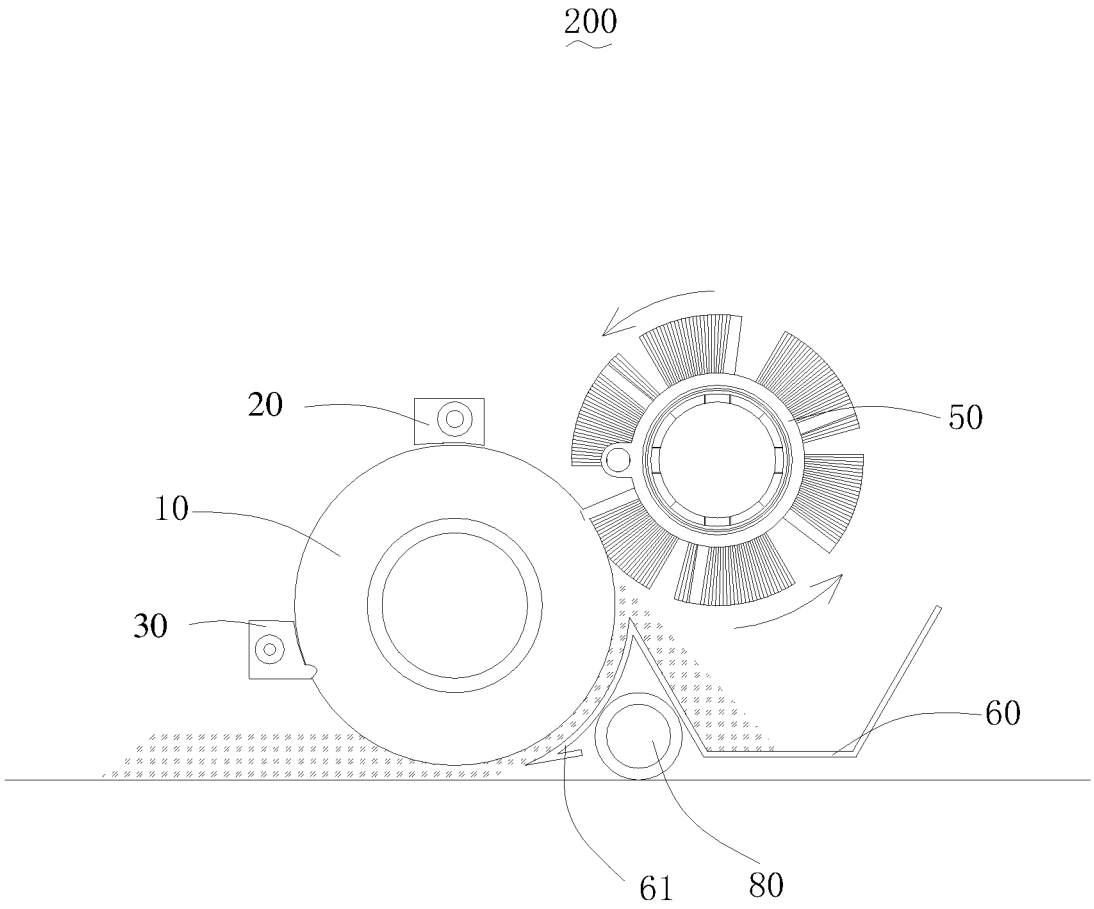
FIG. 3 is a schematic structural view of a cleaning device according to a second embodiment of the present disclosure.

Referring to FIG. 3, the cleaning device 200 of the present embodiment is different from the first embodiment is that the clean water sink 20 is disposed above the flexible roller 10; the sewage sink 30 is disposed on one side of the flexible roller 10, and the top of the sewage sink 30 is closed. The sewage hole 31 is provided at the bottom of the sewage sink 30, so that the sewage sink 30 is closer to the area where the sewage gathers, and the sewage is more easily discharged into the sewage sink 30. At this time, the pressing member 40 is a protrusion 41 provided at the bottom of the sewage sink 30. The protrusion 41 is press-fitted on the surface of the flexible roller 10. When the flexible roller 10 rotates, the protrusion 41 presses the sewage inside the flexible roller 10 to the sewage sink 30.

Embodiment 3

Figure 4:
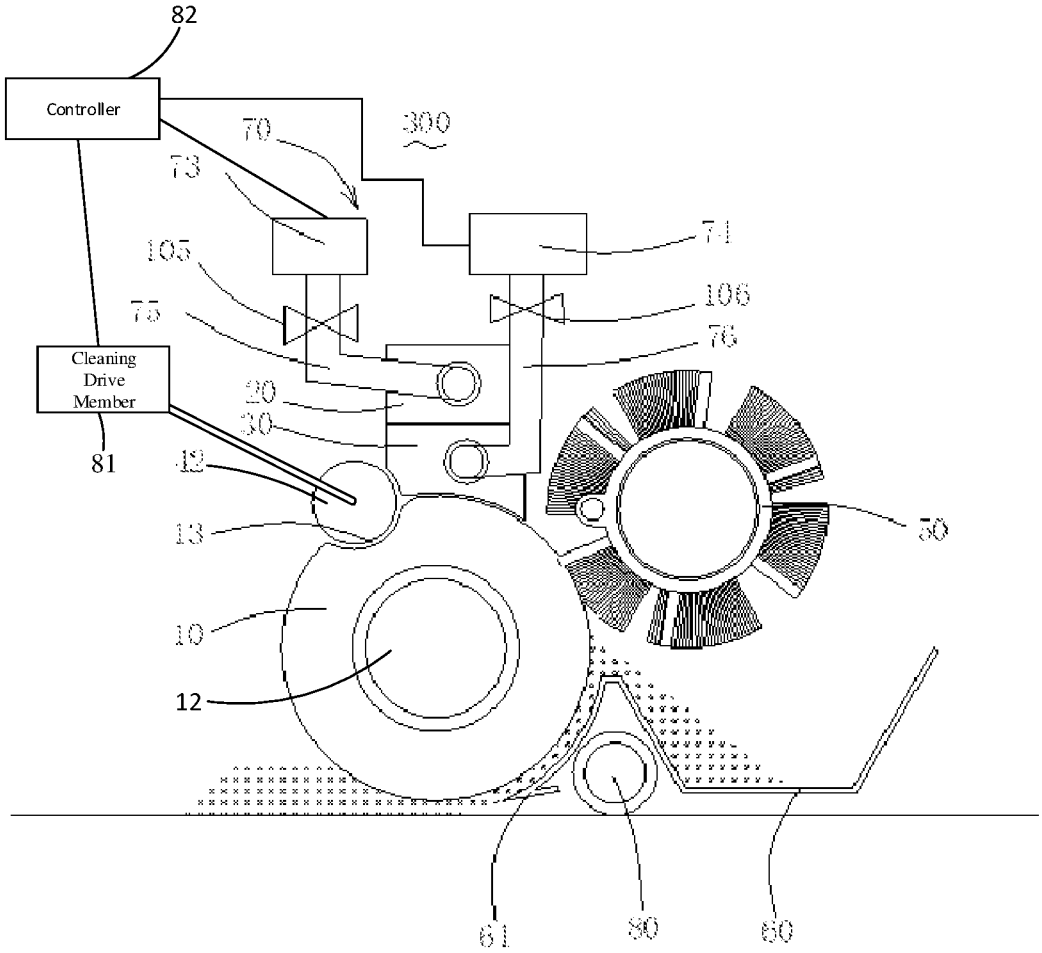
FIG. 4 is a schematic structural view of a cleaning device according to a third embodiment of the present disclosure.

Referring to FIG. 4, the cleaning device 300 of the present embodiment is different from the first embodiment in that the sewage sink 30 is disposed above the flexible roller 10, and a sewage hole 31 is provided at the bottom of the sewage sink 30. The clean water sink 20 is disposed above the sewage sink 30 and connected to the sewage sink 30. A clean water hole 21 is disposed at the bottom of the clean water sink 20. The clean water hole 21 communicates with the sewage sink 30. The clean water is first injected into the clean water sink 20, then flows from the clean water sink 20 onto the flexible roller 10 and into the sewage sink 30. At this time, it can also separate clean water and sewage, but the effect is not as good as in the first embodiment.

Further, one or both ends of the clean water sink 20 communicate with the clean water tank 73 through the clean water pipe 75, and one or both ends of the sewage sink 30 communicate with the sewage tank 74 through the sewage pipe 76. The clean water pipe 75 is provided with a clean water solenoid valve 105. The sewage pipe 76 is provided with a sewage solenoid valve 106. The pressing member 40 is a protrusion 41 provided at the bottom of the sewage sink 30. The sewage sink 30 is connected with a clean driving member that moves up and down. The clean water solenoid valve 105, the sewage solenoid valve 106, and the clean driving member are all electrically connected to a controller 82. The controller 82 controls the clean water solenoid valve 105, the sewage solenoid valve 106, and the clean driving member to open at alternate intervals. This separates the clean water sink 20 and the sewage sink 30 in time and further ensures that the clean water is isolated from the sewage. For example, the sewage sink 30 is connected to an air pump. When the air pump is opened to drive the sewage sink 30 to descend, the flexible roller 10 is pressed downward by the protrusion 41 at the bottom of the sewage sink 30, the sewage solenoid valve 106 is opened to discharge the sewage, and the clean water solenoid valve 105 is closed. When discharging of the sewage is complete, the air pump drives the sewage sink 30 to rise, causing the sewage sink 30 to not press the flexible roller 10, and the clean water solenoid valve 105 opens to provide the flexible roller 10 with clean water.

Of course, the pressing member 40 may also be a pressure column 42. The pressure column 42 is connected to the clean driving member. When the clean driving member is opened, the pressure column 42 descends, the pressure column 42 presses the flexible roller 10, and the sewage solenoid valve 106 opens to discharge the sewage. At this time, the clean water solenoid valve 105 is closed. When the discharge of the sewage is complete, the air pump drives the pressure column 42 to rise, causing the sewage sink 30 to not press the flexible roller 10, the clean water solenoid valve 105 is opened, and the flexible roller 10 is provided with clean water.

Embodiment 4

Figure 5:
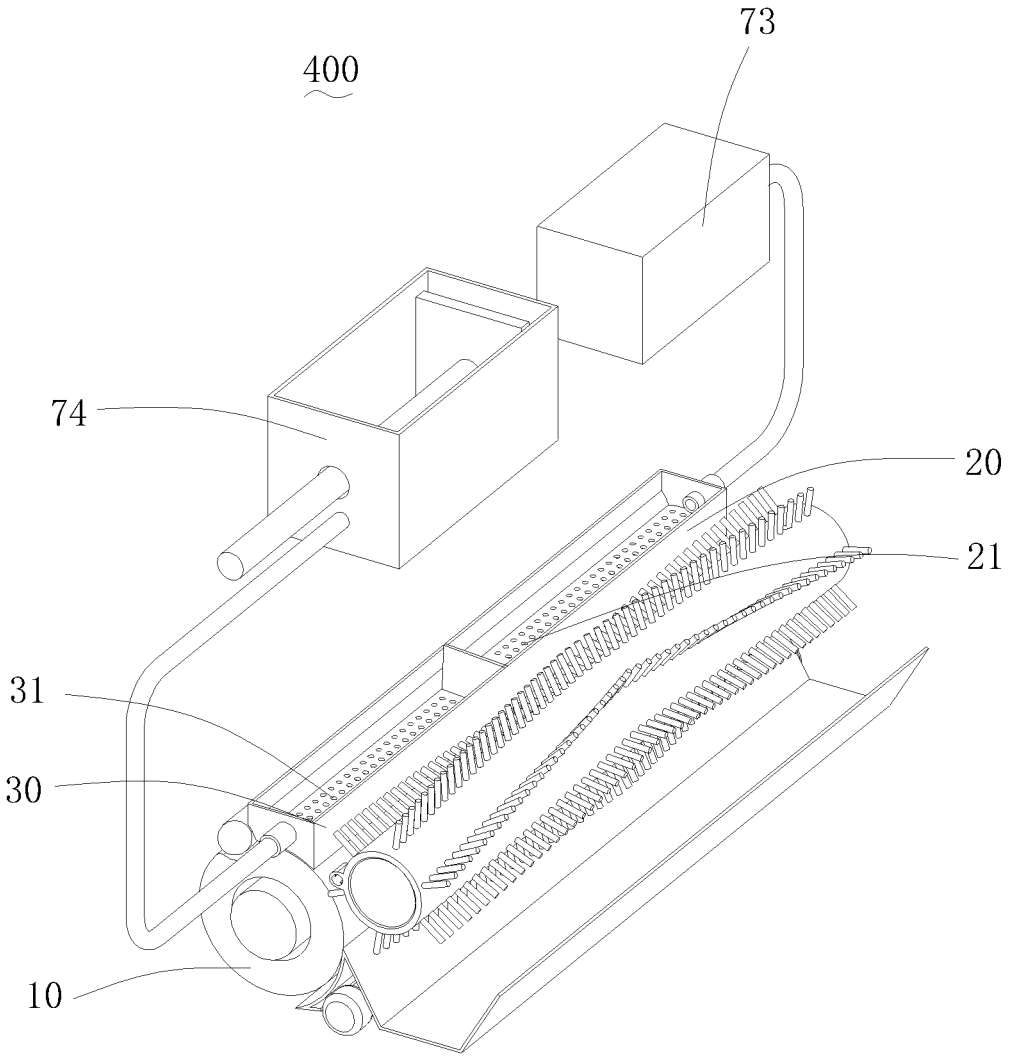
FIG. 5 is a schematic structural view of a cleaning device according to a fourth embodiment of the present disclosure.

Referring to FIG. 5, the cleaning device 400 of the present embodiment is different from the first embodiment in that the sewage sink 30 and the clean water sink 20 are both disposed above the flexible roller 10. The sewage sink 30 is disposed on one side of the clean water sink 20, and the sewage sink 30 and clean water sink 20 are separated from each other. A sewage hole 31 is provided at the bottom of the sewage sink 30, and a clean water hole 21 is disposed at the bottom of the clean water sink 20. This can also provide a certain effect of separation.

Embodiment 5

Figure 6:
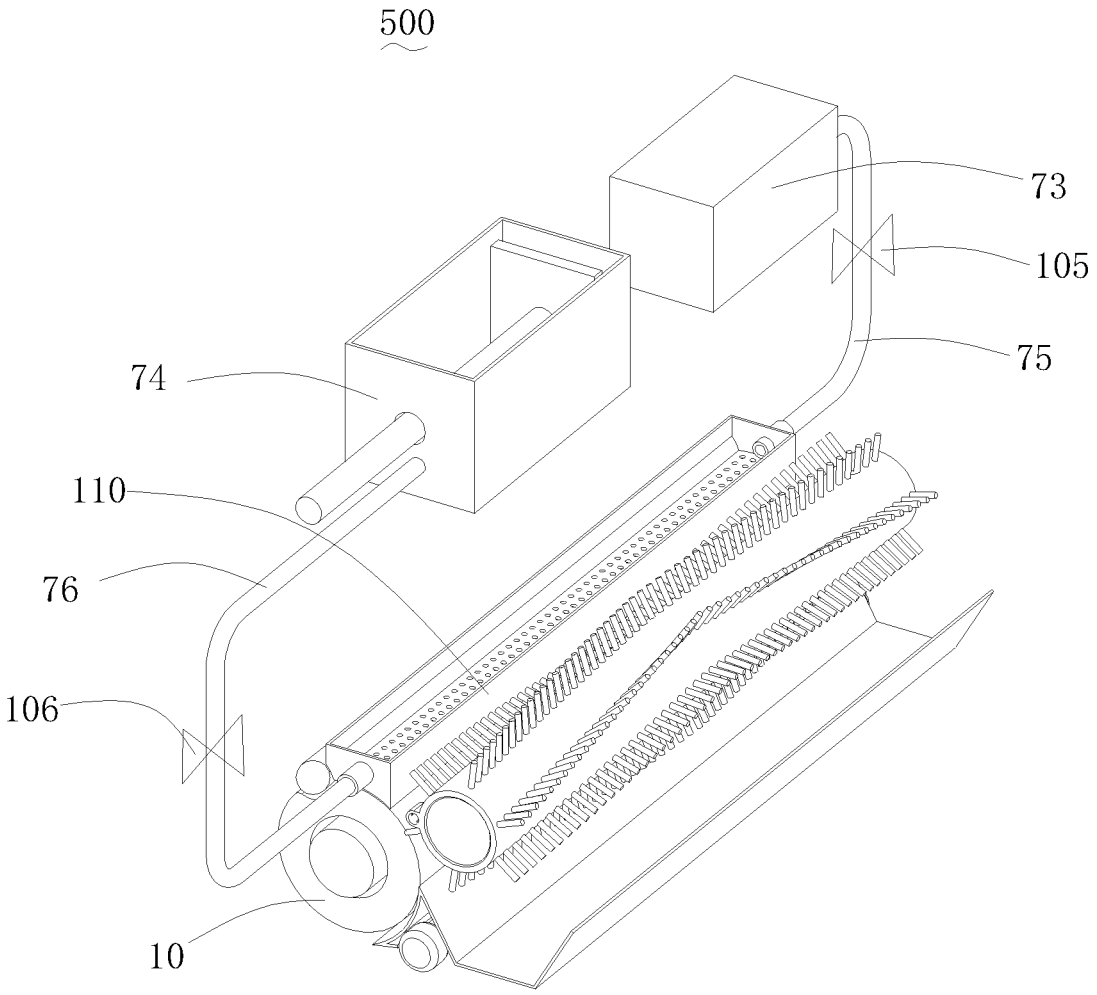
FIG. 6 is a schematic structural view of a cleaning device according to a fifth embodiment of the present disclosure.

Referring to FIG. 6, the cleaning device 500 of the present embodiment is different from the first embodiment in that a tank 110 is shared by the sewage tank and the clean tank. The pressing member 40 is a protrusion 41 or a pressure column 42 disposed at the bottom of the sewage sink 30. The pressing member 40 is connected to a cleaning drive member 81. One end of the clean water sink 20 is connected to the clean water tank 73 through the clean water pipe 75, and the other end passes through the sewage pipe 76 is connected to the sewage tank 74. The clean water pipe 75 is provided with a clean water solenoid valve 105. The sewage pipe 76 is provided with a sewage solenoid valve 106. The clean water solenoid valve 105, the sewage solenoid valve 106 and the cleaning drive member 81 are all electrically connected to a controller 82. The controller 82 controls the clean water solenoid valve and the sewage electromagnetic valve and the drive component to alternately interval open. This separates clean water and sewage in time. For example, the water tank is connected to an air pump. When the cleaning drive member 81 is opened, the pressing member 40 is descending, the pressing member 40 pressed down the flexible roller 10, and the sewage electromagnetic valve is opened to discharge the sewage. At this time, the clean water solenoid valve is closed. When discharging of the sewage is complete, the air pump drives the pressing member 40 to rise without pressing the flexible roller 10, and the clean water solenoid valve opens to provide the flexible roller 10 with clean water.

Embodiment 6

Figure 7:
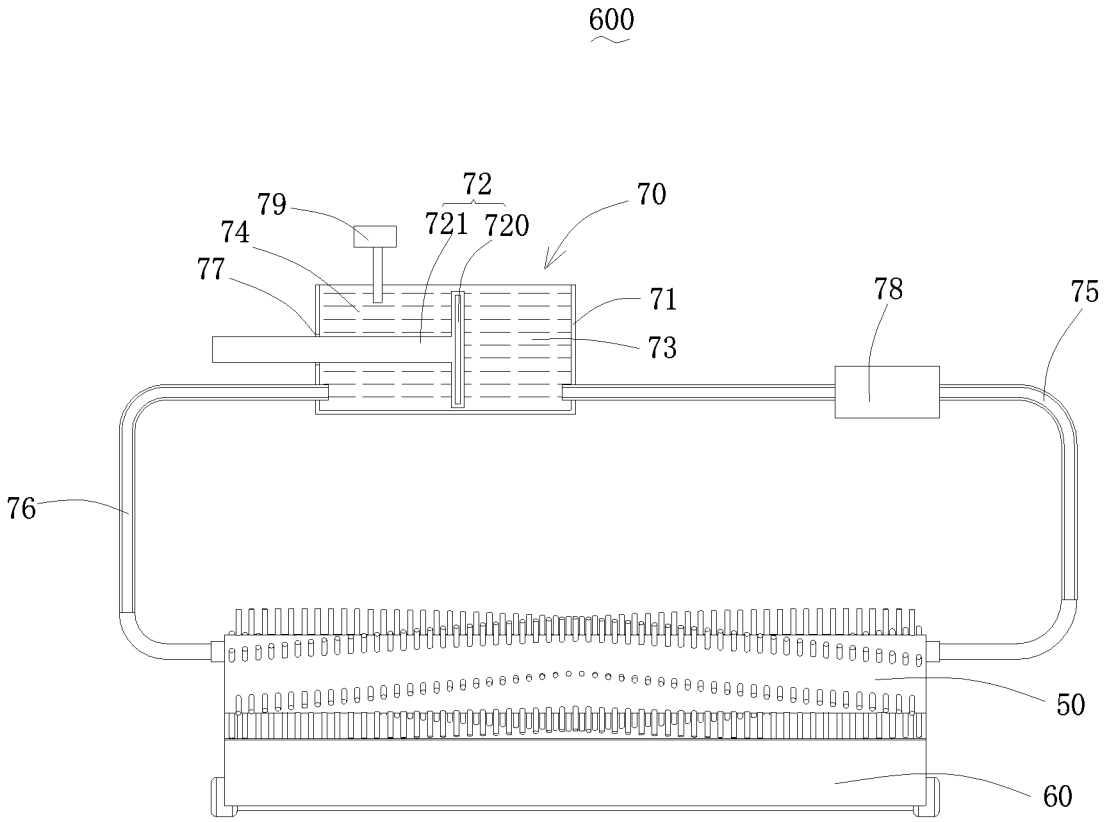
FIG. 7 is a schematic structural view of a cleaning device according to a sixth embodiment of the present disclosure.

Referring to FIG. 7, the cleaning device 600 of the present embodiment differs from the first embodiment in that the cleaning device 100 further includes a water tank 70 for containing the clean water for the clean water sink 20 and the wastewater generated by the flexible roller 10, wherein the water tank 70 is a closed structure.

The water tank 70 includes a tank body 71 and a partition 72 disposed in the tank body 71. The partition 72 divides the tank body 71 into a first cavity 73 and a second cavity 74. The first cavity 73 communicates with a first pipe 75. The second cavity 74 communicates with a second pipe 76. The first cavity 73 is used to contain clean water or sewage, and the second cavity 74 is used to contain sewage or clean water. The partition 72 can be moved along the inner wall of the tank body 71 under external force or pressure to adjust the capacities of the first cavity 73 and the second cavity 74, reduce the volume of the tank body 71, and make the tank body flexible in use. For example, the user directly toggles the partition 72. For example, in the present embodiment, the first cavity 73 is used to contain fresh water, the second cavity 74 is used to contain sewage, the first pipe 75 communicates with the clean water sink 20, and the first cavity 73 provides clean water to the clean water sink 20. The second pipe 76 is connected to the sewage sink 30, and the sewage in the sewage sink 30 enters the second cavity 74 through the second pipe 76.

In this embodiment, the partition 72 includes a moving member 720 and a guiding member 721. The moving member 720 abuts an inner wall of the tank body 71. The guiding member 721 is movably connected to the tank body 71. The moving member 720 is moved along the tank body 71 under the effect of water pressure to adjust the capacities of the first cavity 73 and the second cavity 74. For example, when the volume of clean water entering the tank body 71 is greater than the volume of the sewage entering the tank body 71, the moving member 720 is subjected to the water pressure of the clean water and moves toward the sewage cavity. Conversely, when the volume of the sewage entering the tank body 71 is larger than the clean water the volume of clean water entering in the tank body 71, the moving member 720 is subjected to the water pressure of the sewage and moves toward the clean water cavity.

In this embodiment, a guiding hole 77 is defined in a side wall of the tank body 71. The guiding member 721 is sealed and installed in the guiding hole 77 to guide the moving member 720 to move. Because the guiding member 721 is sealed and installed in the guiding hole 77, water leakage can be prevented. For example, a seal apron is provided around the guiding hole 77. Preferably, the guiding hole 77 is disposed at a top of the tank body 71. In this way, water leakage from the tank body 71 through the guiding hole 77 can be prevented. In other embodiments, the guiding hole 77 is disposed at other positions of the tank body 71.

In this embodiment, the guiding member 721 is movably connected to the left side or the right side of the tank body 71. That is, the guiding hole 77 is disposed on the left side or the right side of the tank body 71, and the first pipe 75 communicates with the left side of the tank body 71. The second pipe 76 communicates with the right side of the tank body 71.

Further, a clean water pump 78 is disposed on the first pipe 75 to provide power for clean water to enter into the clean water sink 20. The second cavity 74 communicates with a vacuum pump 79 through a pipe. The vacuum pump 79 can increase the negative pressure for the second cavity 74 to inhale the sewage from the sewage sink 30.

Still further, a water level sensor is disposed on the inner wall of the second cavity 74 at the top, and a water alarm is set on the cleaning robot. The water alarm is electrically connected with the water level sensor. When the sewage in the second cavity 74 is full, the water level sensor senses the water level signal from the second cavity 74 and sends the signal to the water alarm. The water alarm sends sounds or flashes according to the signal to alert the user to clean the sewage tank.

Embodiment 7

Figure 8:
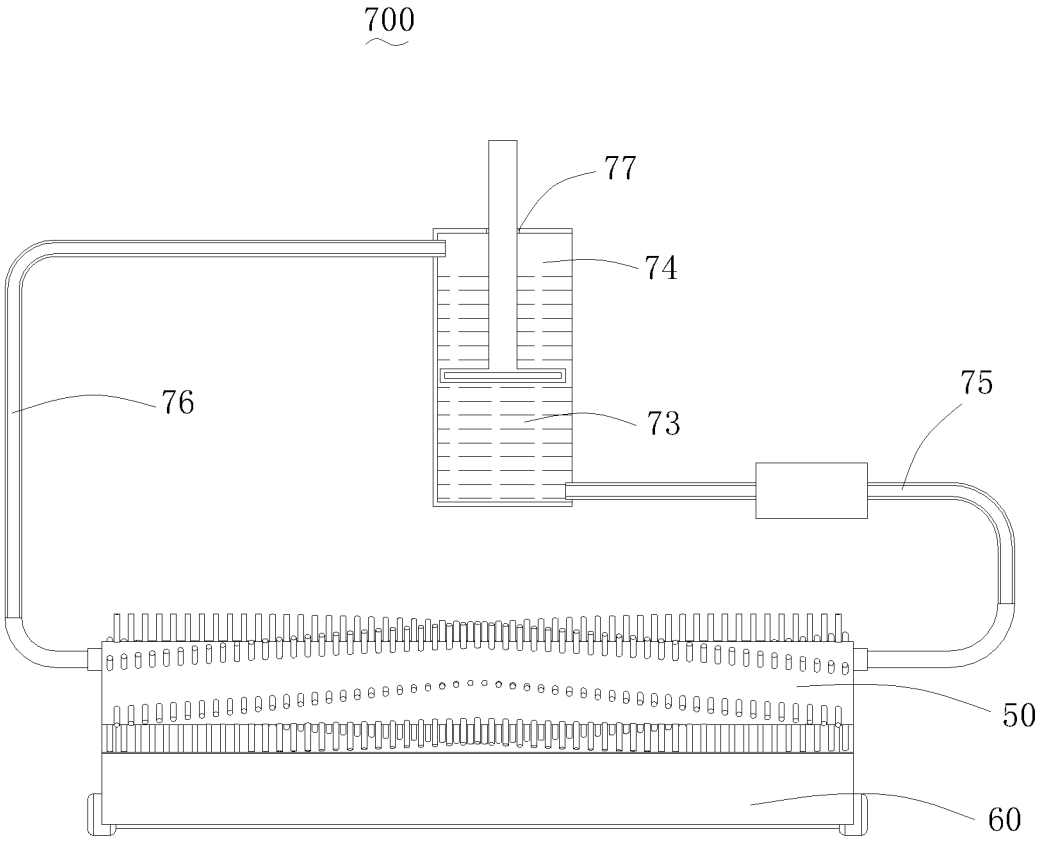
FIG. 8 is a schematic structural view of a cleaning device according to a seventh embodiment of the present disclosure.

Referring to FIG. 8, the cleaning device 700 of the present embodiment is different from the sixth embodiment in that the guiding member 721 of the water tank 70 is movably connected to the top or bottom of the tank body 71. That is, the guiding hole 77 is disposed on the top or at the bottom of the tank body 71. The first pipe 75 communicates with the tank body 71 at a lower position, and the second pipe 76 communicates with the tank body 71 at an upper position.

Embodiment 8

Figure 9:
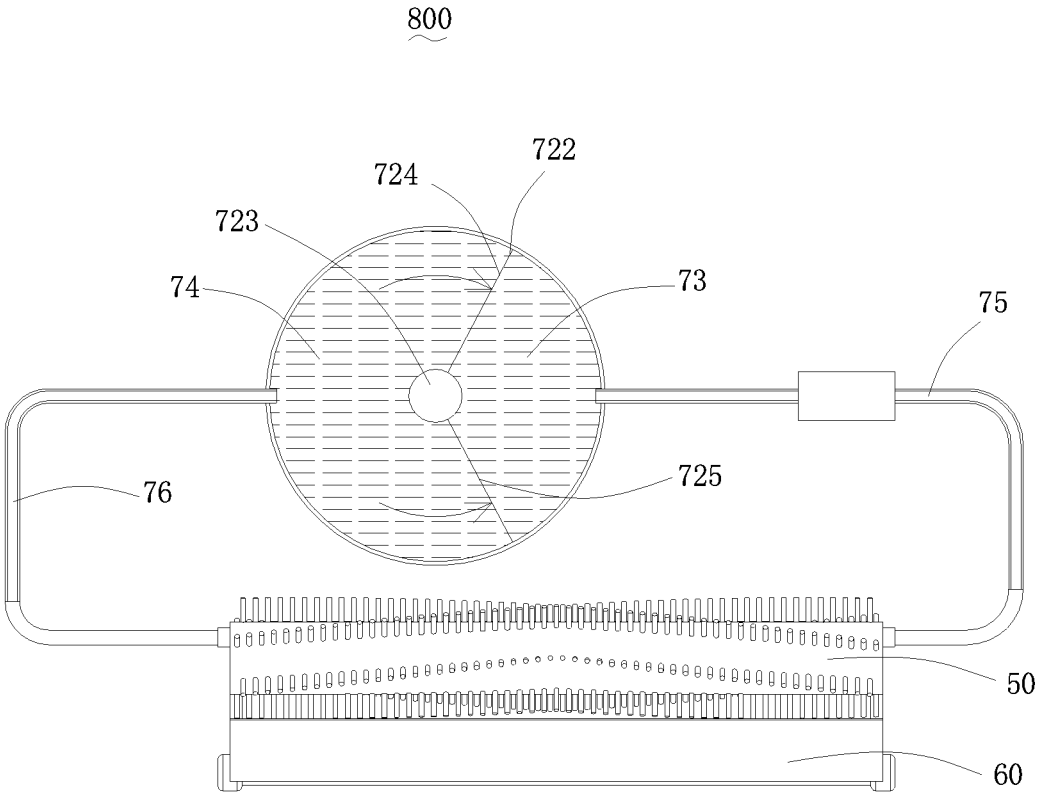
FIG. 9 is a schematic structural view of a cleaning device according to an eighth embodiment of the present disclosure.

Referring to FIG. 9, the cleaning device 800 of the present embodiment is different from the fourth embodiment is that the partition 72 includes a loose leaf 722 and a rotating shaft 723. The loose leaf 722 includes a first partition 724 and a second partition 725. The first partition 724 and the second partition 725 are respectively pivotally connected to a rotating shaft 723 so as to rotate along the rotating shaft 723 due to water pressure. The first partition 724 and the second partition 725 respectively abut against the tank body 71, and the rotating shaft 723 connects to the tank body 71 such that the first cavity 73 and the second cavity are formed between the first partition 724 and the second partition 725. When the water pressure on one side is relatively high, the first partition 724 and the second partition 725 move in the opposite direction to adjust the capacities of the first cavity 73 and the second cavity 74.

The above-mentioned embodiments merely represent several embodiments of the present disclosure, and the description thereof is more specific and detailed, but it should not be understood as a limitation of the scope of the present disclosure. It should be noted that, for those skilled in the art, several variations and improvements may be made without departing from the concept of the present disclosure, and these are all within the protection scope of the present disclosure. Therefore, the scope of protection of the present disclosure shall be subject to the appended claims.

The invention claimed is:

1. A cleaning device, comprising:
- a flexible roller for cleaning a floor;
- a roller motor for driving the flexible roller to rotate;
- a pressing member for deforming the flexible roller to press out sewage;
- a cleaning drive member connected to the pressing member for controlling the pressing member to press on the flexible roller;
- a plurality of water tanks, wherein the plurality of water tanks comprises a clean water tank and a sewage tank;
- a clean water sink, wherein:
  - a gap is defined between the flexible roller and the clean water sink,
  - a clean water hole is disposed at a bottom of the clean water sink,
  - the clean water sink is connected to the clean water tank through a clean water pipe, and
  - a clean water solenoid valve is provided on the clean water pipe;
- a sewage water sink, wherein:
  - the sewage water sink is connected to the sewage tank through a sewage pipe, and
  - a sewage solenoid valve is provided on the sewage pipe; and
- a controller electrically connecting to the clean water solenoid valve and the sewage solenoid valve, wherein the controller is used to control the clean water solenoid valve and the sewage solenoid valve to open at alternate intervals.

2. The cleaning device of claim 1, wherein the cleaning device is a sweeping robot.

3. A cleaning device comprising:
- a flexible roller for cleaning a floor;
- a pressing member for deforming the flexible roller to press out sewage;
- a clean water sink, wherein:
  - the clean water sink defines a clean water hole, and
  - clean water in the clean water sink flows to the flexible roller through the clean water hole;
- a garbage collection box disposed adjacent the flexible roller;
- a load bearing wheel disposed between the garbage collection box and the flexible roller; and
- a sewage sink, wherein:
  - the sewage sink defines a sewage hole, and
  - the sewage sink is adjacent to the pressing member such that when the pressing member deforms the flexible roller and presses out the sewage, the sewage passes through the sewage hole and flows into the sewage sink.

4. The cleaning device of claim 3, comprising a roller brush disposed above the garbage collection box and in contact with the flexible roller.

5. The cleaning device of claim 4, wherein the roller brush is configured to rotate in a first direction and the flexible roller is configured to rotate in a second direction opposite the first direction.

6. The cleaning device of claim 3, comprising a scraper, wherein the load bearing wheel is disposed between the garbage collection box and the scraper.

7. The cleaning device of claim 3, comprising a roller motor for driving the flexible roller to rotate, wherein the flexible roller surrounds the roller motor.

8. The cleaning device of claim 3, wherein the cleaning device is a sweeping robot.

* * * * *